US006052984A

United States Patent [19]

Summerer

[11] Patent Number: 6,052,984

[45] **Date of Patent: *Apr. 25, 2000**

[54] TEXTILE DRAFTING MACHINE WITH UPSTREAM DIRT SEPARATING DEVICE

[75] Inventor: Hans Summerer, Reichertshofen, Germany

[73] Assignee: Rieter Ingolstadt Spinnereimaschinenbau AG, Ingolstadt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/923,446

[22] Filed: Sep. 4, 1997

[30] Foreign Application Priority Data

Oct. 2, 1996 [DE] Germany ..... 196 40 691

[51] Int. Cl.[7] ..... D01H 5/28

[52] U.S. Cl. ..... 57/315; 19/236; 19/263; 57/304

[58] Field of Search ..... 57/315, 304; 19/236, 19/262, 263, 264, 265, 288, 258, 150, 200

[56] References Cited

U.S. PATENT DOCUMENTS

| | | | |
|---|---|---|---|
| 3,307,227 | 3/1967 | Bryan | 19/258 |
| 3,377,665 | 4/1968 | Kincaid . | |
| 3,381,343 | 5/1968 | Miller et al. | 19/258 |
| 3,409,946 | 11/1968 | Whitehurst | 19/288 |
| 4,112,548 | 9/1978 | Sauvage | 19/258 |
| 4,306,337 | 12/1981 | Sutter . | |
| 4,884,320 | 12/1989 | Gasser et al. . | |
| 5,018,248 | 5/1991 | Haworth et al. | 19/236 |

FOREIGN PATENT DOCUMENTS

| | | | |
|---|---|---|---|
| 000583U1 | 1/1996 | Austria . | |
| 50933 | 5/1982 | European Pat. Off. | 19/200 |
| 3630941 C2 | 4/1989 | Germany . | |
| 3734246 | 4/1989 | Germany | 19/263 |
| 19518302 A1 | 11/1996 | Germany . | |
| 176642 | 3/1922 | United Kingdom . | |

OTHER PUBLICATIONS

German Search Report, Feb. 3, 1997.

*Primary Examiner*—William Stryjewski
*Attorney, Agent, or Firm*—Dority & Manning

[57] ABSTRACT

A textile machine is provided with drafting equipment for drafting fiber material. The drafting equipment includes a suction device disposed to remove dirt separated from the fiber material. The textile machine further includes a guiding device configured to guide fiber material into an inlet of the drafting equipment. The guiding device further includes a dirt separating device configured therewith so that dirt particles are separated from the fiber material prior to the fiber material reaching the inlet of the drafting equipment.

12 Claims, 3 Drawing Sheets

TEXTILE DRAFTING MACHINE WITH UPSTREAM DIRT SEPARATING DEVICE

BACKGROUND OF THE INVENTION

The present invention relates to a textile machine with drafting equipment for fiber material, whereby a guiding device is provided to guide the fiber material on the textile machine up to the inlet into the drafting equipment and whereby a suction device is provided on the drafting equipment to remove collected dirt.

The term "textile machine" comprises pre-spinning machines such as cards or draw frames as well as spinning machines equipped with drafting equipment. Textile machines are made with non-autolevelling or autolevelling drafting equipment. These textile machines process textile fiber material. The fiber material may be in the form of fiber fleece or fiber sliver. The present invention relates to a part of the textile machine which is to be considered part of the drafting equipment. Before entry into the drafting equipment, the fiber material is fed to a guiding device. Upon leaving the drafting equipment, the fiber sliver can be deposited in cans or be taken to another textile machine for further processing. When processing very dirty cotton, large quantities of dirt reach the operating elements of the spinning machines together with the fiber material. Especially with open end spinning machines, the dirt cannot always be separated from the dirt collection device (opener roller) in that machine. The consequence of this is increased dirt deposited in the yarn and on the operating elements of the spinning machine and greater need for cleaning of the dirt-sensitive operating elements such as, e.g., the rotor in the open-end spinning machine. In draw frames, especially with drafting, a known dirt separation effect already takes place. The separated dirt is removed from the drafting equipment by known means. The separation of dirt during the drafting process of the fiber material has become known as a side effect of the actual drafting. This dirt separation is however often insufficient in order to ensure a high-quality further processing of the fiber material. Means for increased dirt separation on textile machines of the same type have not been found.

OBJECTS AND SUMMARY OF THE INVENTION

It is a principal object of the invention to ensure considerably increased dirt separation in processing very dirty textile fiber material on a textile machine with drafting equipment by means of said drafting equipment. Additional objects and advantages of the invention will be set forth in part in the following description, or may be obvious from the description, or may be learned through practice of the invention.

The objects are attained according to the invention in that means for dirt separation from the fiber material are provided in the guiding device. The means for dirt separation consist of a lower part and an upper part between which the fiber material is moved, whereby means are provided on the surfaces facing each other of the upper and lower parts so that alternating surface rises and surface depressions are formed there at a right angle to the running direction of the fiber material, these entering each other so that an alternating, slight deflection of the direction of the fiber material flow ensues. The lower part is held by means of a holder in a guiding device. In one embodiment, the upper part can be connected to a presentation device. In that case, the presentation device is connected to controls of the textile machine. The presentation device makes it possible for the upper part to be presented to the lower part or to be withdrawn from it between a defined opening position and a defined work position. The work position ensures such a gap between upper and lower part that no wrong drafting of the fiber material occurs, but so that an alternating, slight deflection of the fiber material running direction takes place. In order to avoid wrong drafting, it is possible to equip the upper part in the presentation means with spring elements which make it possible to lift the upper part in the presentation means through thick spots in the fiber material.

In an advantageous embodiment, the lower part consists of a screen. Below this screen is a container to receive the separated dirt. In another embodiment, at least the lower part consists of a screen.

In another embodiment, the means for dirt separation is connected to a pneumatic suction device. The lower part in the form of a screen is preferably connected to the suction device. In another embodiment, the means for dirt separation is installed on the guiding device in the direction of fiber material movement in front of a funnel of a pair of scanning rollers. In another simplified embodiment the means for dirt separation is placed in front of a pair of scanning rollers.

The invention makes it possible to reduce dirt in cotton with a high degree of soiling, in particular hull parts in the fiber material, by approximately 20 to 30%. With an open-end spinning machine for example, the cost of dirt separation and the cost for rotor cleaning are maintained to the usual level. By reducing the degree of soiling of the fiber material by means of the dirt separation system according to the invention, the frequency of yarn breakage on the spinning machine can be reduced.

The invention is simple in design and easily configured, and thereby economical and also capable of being retrofitted on already existing textile machines.

Examples of embodiments of the invention are shown in the drawings and are described in further detail below.

DETAILED DESCRIPTION OF THE INVENTION

Figure 1:
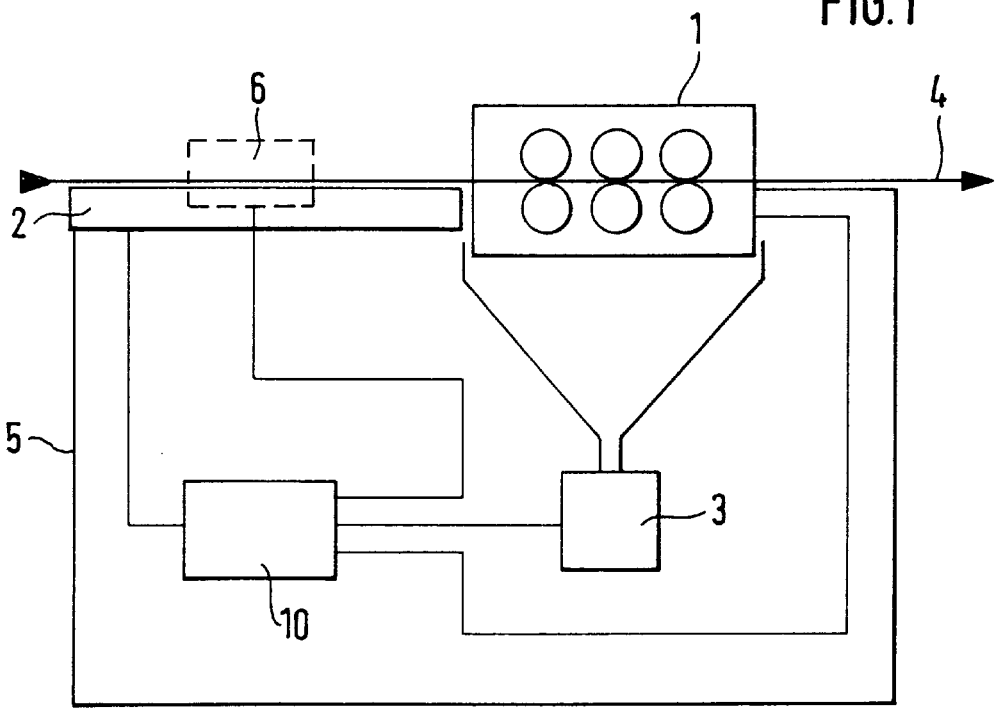
FIG. 1 shows part of the drafting equipment of a prespinning machine.

Reference will now be made in detail to the presently preferred embodiments of the invention, one or more examples of which are shown in the drawings. Each example is provided by way of explanation of the invention, and not as a limitation of the invention. For example, features illustrated or described as part of one embodiment can be used on another embodiment to yield still a further embodiment.

The card, the combing machine, and the draw frame are prespinning machines. While the draw frame cannot operate without drafting equipment, card and combing machine may or may not possess drafting equipment. The object of the invention focuses on the drafting equipment portion.

FIG. 1 shows the schematic design of part of the drafting equipment of a pre-spinning machine. A guiding device 2 for the fiber material and drafting equipment 1 are installed on a frame 5. The fiber material is conveyed to the guiding device 2, runs through it and reaches the inlet of the drafting equipment 1. The fiber material is conveyed through the drafting equipment and leaves the drafting equipment at the outlet. The fiber material conveyed from the outlet of the drafting equipment 1 can be deposited by a depositing device (not shown) in a container or can be conveyed further to a downstream machine for further processing by, e.g. a spinning machine.

The drafting equipment can operate without or with draw. Drafting equipment with unregulated or with regulated draw is also acceptable for the fiber material. This does not affect the invention.

Depending on the type of pre-spinning machine, a guiding device may be provided with means for the improvement of the guidance, for measuring the fiber material, or operating elements to compress and/or double the fiber material.

The fiber material can be in the form of fiber fleece, fiber sliver, or a fiber combination of doubled individual fibers slivers. Cotton or its mixture with synthetic fibers is processed.

It is known that dirt is separated as fiber material runs through drafting equipment. The dirt consists of solid dirt particles of cotton such as shell parts, dust or foreign particles. For this reason, a device for dust collection is provided as a rule on the drafting equipment. This can be a container which can be emptied, in the simplest case, or a pneumatic suction device 3. Controls 10 can be provided as a function of the type of drafting equipment 1 used. The controls can be identical with the machine controls of the pre-spinning machine or they may be separate controls for part of the drafting equipment. As is known, controls 10 control the draw of the drafting equipment 1. The controls 10, in combination with the guiding device 2, however also assumes the control of local operating organs such as the draw-in rollers and/or scanning rollers. The controls 10 can also control an existing suction device 3. The basic arrangement is also applicable to the drafting equipment of a ring spinning machine, for example.

FIG. 1 shows that means 6 for dirt separation from the fiber material are installed in the guiding device 2. These means 6 for dirt separation can be connected to the controls 10 in a special embodiment.

Figure 2:
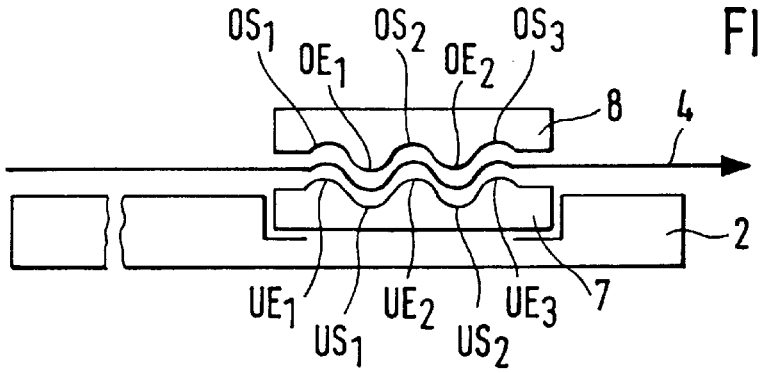
FIG. 2 shows means for dirt separation.

FIG. 2 shows further details concerning the means 6 for dirt separation. The means 6 for dirt separation consist of a lower part 7 and an upper part 8 between which the fiber material can be conveyed. On the surfaces of the upper and lower parts facing each other additional means are provided which constitute the alternating raised surface areas OE1, OE2, UE1, UE2, UE3 and the depressed surface areas OS1, OS2, OS3, US1, US2 at a right angle to the running direction 4 of the fiber material. These means are offset relative to each other, i.e. that one raised surface area of the upper part is across from a depressed surface area in the lower part. Raised surface areas and depressed surface areas therefore interact as the lie across from each other. A gap remains between the upper and lower parts. Upper and lower parts are placed parallel to each other. The fiber material is conveyed through this gap. The gap is designed so that no disadvantageous drafting of the fiber material occurs. Arrangements of upper and lower parts are also possible, where these are tilted out of plumb as they follow a conveying direction of the fiber material. Lying on the guiding device 2, the fiber material is conveyed in the direction of the input to drafting equipment 1. The means 6 for dirt separation are placed in the guiding device 2 in such a manner that the conveying direction 4 of the fiber material is not changed in the direction of the inlet of the drafting equipment 1. The means 6 for dirt separation are placed in the guiding device 2 in such a manner that the entry and the exit of the fiber material into the means 6 for dirt separation takes place continuously from the conveying direction 4.

Figure 3:
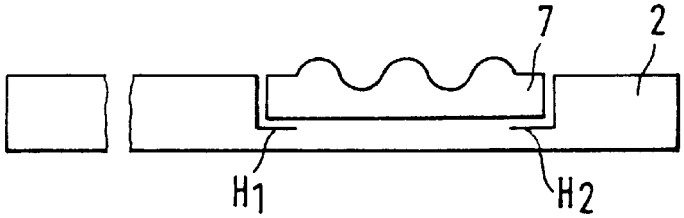
FIG. 3 shows the lower part with holder on the guiding device.

FIG. 3 shows that the lower part 7 is held in the guiding device 2 by means of holder H1, H2.

Figure 4:
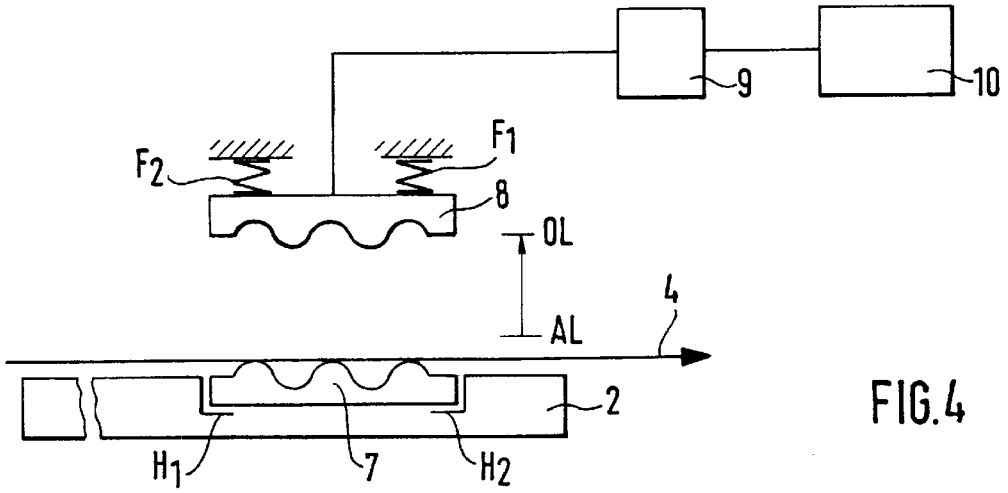
FIG. 4 shows the presentable upper part in an open position.

FIG. 4 shows that in another embodiment the upper part 8 can be connected to a presentation device 9. The presentation device is an arrangement which works on mechanical, electromechanical, pneumatic or hydraulic basis to move the upper part 8 from an open position OL into a work position AL or to move it back. The presentation device 9 is controlled by controls 10. The open position OL must be selected so that it is possible for the operator to introduce a beginning of the fiber material between the upper and the lower part. The operating position AL must correspond to the position which enables an alternating, slight deflection of the fiber material direction of movement.

Figure 5:
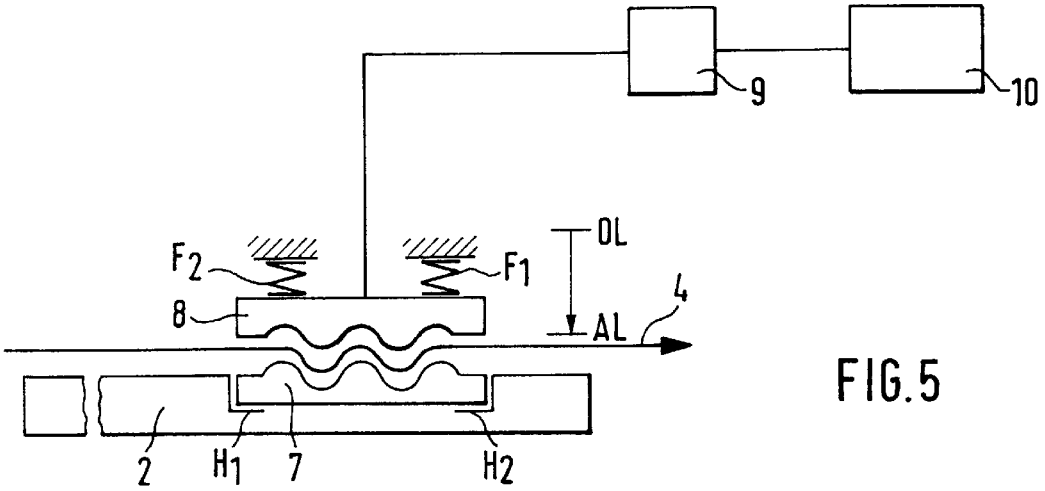
FIG. 5 shows the presentable upper part in a work position.

In continuation, FIG. 5 shows the state of the upper part 8 in operating position AL. In another embodiment the upper part 8 can be equipped with the spring elements F1, F2. As thick spots in the fiber material enter, a yielding, i.e. a lifting, of the upper part 8 is made possible. This is a measure taken in order to avoid an accidental wrong drafting of the fiber material.

Figure 6:
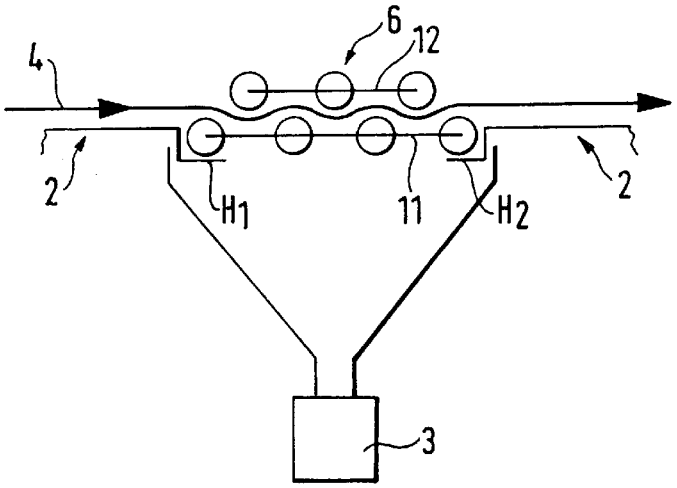
FIG. 6 shows means for dirt separation made in the form of a screen connected to a suction device.

The operating position AL of the upper part 8 must be found empirically and be adjusted to a value gained from experience. This operating position AL must ensure that an alternating, slight deflection of the fiber material's direction of movement takes place. The dirt separated by the means 6 must not result in hindering the fiber material from taking its new direction of flow. For this purpose the lower part is made in the form of a screen 11 in another embodiment according to FIG. 6, and the upper part in form of another screen 12. The screen is formed by grid rods which are placed in one plane and move parallel to each other. The screen rods hare held by their head ends by means of a frame. Screen 11 is located in the holder H1, H2 of a guiding device 2. The screen 12 can for example be fixed manually or by means of the presentation device 9 in the operating position AL. The screen 12 must be fixed in its operating position AL. A suction system 3 is installed below the screen 11 to collect and suck away the separated dirt.

It is also possible to make an embodiment in which only the lower part 7 is made in the form of a screen 11. The upper part 8 need not be made in the form of a screen but could be a cover with the previously mentioned surface depressions and raised surface areas.

Figure 7:
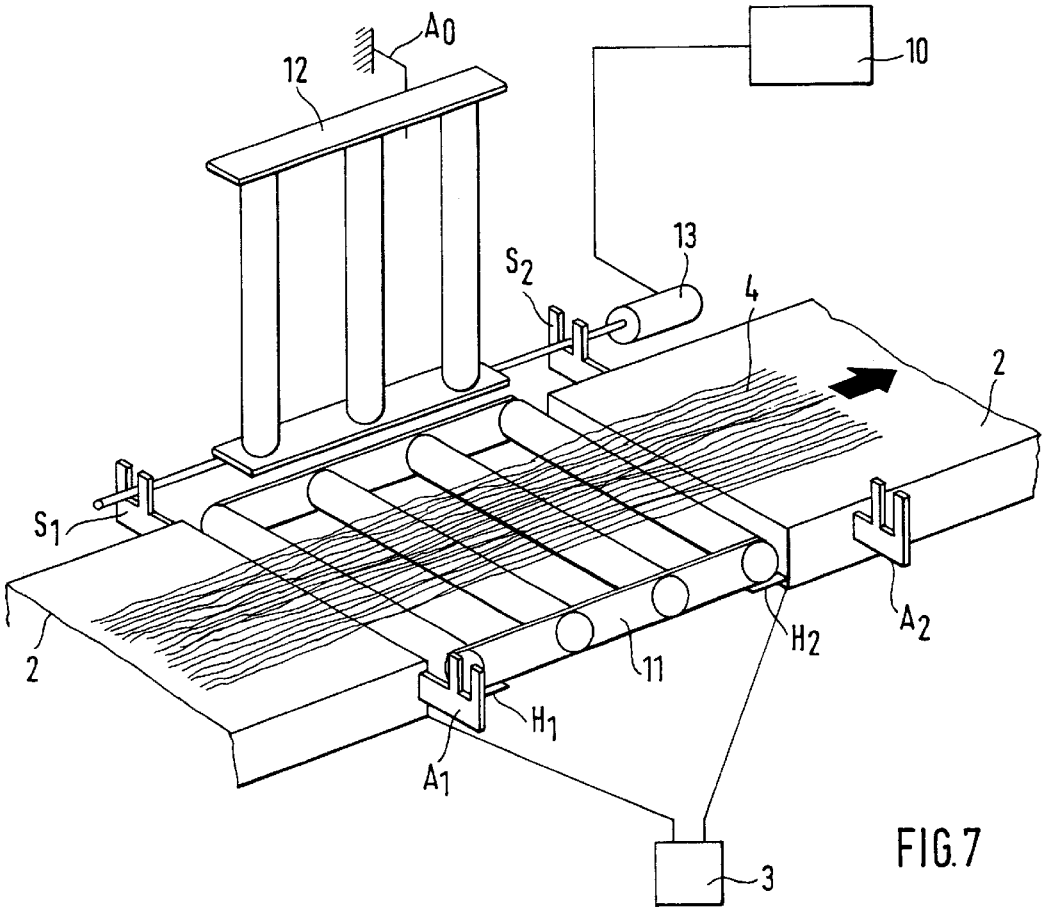
FIG. 7 shows an embodiment of a screen which can be presented by means of a controlled servomotor.

FIG. 7 shows another possibility for means 6 for dirt separation in combination with a presentation device 9 and controls 10. In a guiding device 2, a screen 11 is held by the holder H1, H2. Below the screen 11 is a suction device 3. In hinges S1, S2 which are located outside the running path of the fiber material on the guiding device 2, a screen 12 is mounted pivotably by means of bolts. One side of the swiveling motion is delimited by a stop A0 which corresponds to an open position OL. The screen continues to be connected to the shaft of a servo-motor 13 in extension of a bolt. The servomotor 13 is controlled by controls 10. The servomotor allows for right as well as left direction operation. In case of a position-guided servomotor (i.e. with bearing control) the stop A0 can be omitted, since the servo-motor would then be able to position and hold the screen 12 exactly.

When fiber material is laid on the screen 11, the servomotor 13 can be steered in the opposite running direction, so that the screen 12 is moved with the other bolts up to stop A1, A2. The screen rods of the screen 12 reach into the gaps between the screen rods of screen 11. Hinge S1, S2 and stop A1, A2 are located in such a manner on the guiding device that a distance or gap is fixed between screen 11 and screen 12 so that the fiber material is touched by the screen rods of screens 11 and 12 and a alternating slight deflection of the fiber material in its running direction ensues. The gap may however not produce any undesirable drafting of the fiber material.

Figure 8:
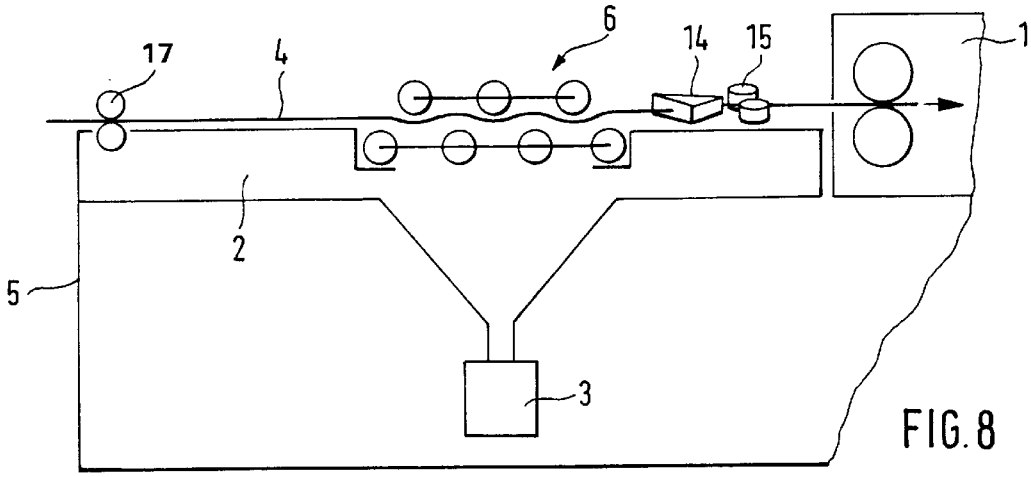
FIG. 8 shows means for dirt separation on a guiding device in front of a funnel for sliver doubling and a pair of scanning rollers.

FIG. 8 shows in addition that with an auto-leveller a pair of draw-in rollers 13 is installed in the guiding device 2, as well as a funnel 14 for the doubling of the fiber material and a pair of scanning rollers to determined the thickness of the fiber material. The means 6 for dirt separation are placed in this autoleveller as shown in FIG. 8 in the conveying direction of the fiber material, preferably on the guiding device 2 before a funnel 14 of a pair of scanning rollers 15, i.e. between the pair of draw-in rollers 2 and the funnel 14.

It should be apparent to those skilled in the art that various modifications and variations can be made in the present invention without departing from the scope and spirit of the invention. It is intended that the present invention cover such modifications and variations as come within the scope of the appended claims and their equivalents.

I claim:

1. A textile machine with drafting equipment for drafting fiber material, said drafting equipment comprising a suction device for removing dirt separated from said fiber material, said machine comprising a guiding device configured to guide fiber material into an inlet of said drafting equipment, and said guiding device further comprising a generally non-drafting dirt separating device configured therewith wherein dirt particles are separated from said fiber material prior to said fiber material reaching said inlet of said drafting equipment.

2. The textile machine as in claim 1, wherein said dirt separating device comprises a lower part and an upper part defining a space therebetween through which said fiber material is conveyed, said lower and upper part having opposite faces with a configuration so that alternate raised and depressed surfaces are disposed in said space thereby defining an alternating path for said fiber material between said lower and upper parts.

3. The textile machine as in claim 2, wherein said lower part is held by a holder device.

4. The textile machine as in claim 3, wherein said upper part is configured with a movable presentation device that moves said upper part from an open position to a work position adjacent said lower part.

5. The textile machine as in claim 4, wherein said upper part is installed in said presentation with spring elements.

6. The textile machine as in claim 2, wherein said lower part is formed at least in part from a screen material.

7. The textile machine as in claim 6, wherein said upper part is formed at least in part from a screen material.

8. The textile machine as in claim 6, further comprising a container for collection of dirt particles disposed below said lower part.

9. The textile machine as in claim 1, wherein said dirt separating device is in pneumatic communication with said suction device.

10. The textile machine as in claim 9, wherein said dirt separating device comprises a lower part and an upper part defining a space therebetween through which said fiber material is conveyed, said lower and upper parts having opposite faces with a configuration so that alternate raised and depressed surfaces are disposed in said space thereby defining an alternating path for said fiber material between said lower and upper parts, said lower part in pneumatic communication with to said suction device.

11. The textile machine as in claim 1, wherein said drafting equipment comprises a pair of scanning rollers, said means for separating dirt particles disposed operably upstream of said pair of scanning rollers in a conveying direction of said fiber material.

12. The textile machine as in claim 11, wherein said scanning rollers further comprise a funnel, said means for separating dirt particles disposed operably upstream of said funnel in a conveying direction of said fiber material.

* * * * *